US006672376B2

(12) United States Patent
Shembekar et al.

(10) Patent No.: US 6,672,376 B2
(45) **Date of Patent: *Jan. 6, 2004**

(54) TWISTED-LOUVER HIGH PERFORMANCE HEAT EXCHANGER FIN

(75) Inventors: Ajit R. Shembekar, Farmington Hills, MI (US); Barry W. Blumel, Livonia, MI (US); Eugene E. Rhodes, Belleville, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 23 days.

This patent is subject to a terminal disclaimer.

(21) Appl. No.: 09/749,208

(22) Filed: Dec. 27, 2000

(65) Prior Publication Data

US 2002/0079092 A1 Jun. 27, 2002

(51) Int. Cl.[7] ..... F28D 1/02; F28F 13/12

(52) U.S. Cl. ..... 165/152; 165/153; 165/109.1; 165/174; 138/38

(58) Field of Search ..... 165/152, 151, 165/153, 109.1, 174; 138/38

(56) References Cited

U.S. PATENT DOCUMENTS

| | | | | | |
|---|---|---|---|---|---|
| 1,013,973 | A | * | 1/1912 | Trisler | 165/153 |
| 1,454,483 | A | * | 5/1923 | Modine | 165/151 |
| 1,618,980 | A | * | 3/1927 | Fedders | 165/153 |
| 1,675,796 | A | * | 7/1928 | Fedders | 165/153 |
| 1,726,360 | A | * | 8/1929 | Modine | 165/152 |
| 1,770,208 | A | * | 7/1930 | Kemnal | 165/174 |
| 2,079,144 | A | * | 5/1937 | Appa | 138/38 |
| 2,660,198 | A | * | 11/1953 | Morrow | 138/38 |
| 4,265,275 | A | * | 5/1981 | Heller et al. | 138/38 |
| 5,099,914 | A | | 3/1992 | Reifel | |
| 5,390,731 | A | | 2/1995 | Selm et al. | |
| 5,669,438 | A | | 9/1997 | Beales et al. | |
| 5,730,214 | A | | 3/1998 | Beamer et al. | |
| 6,170,566 | B1 | * | 1/2001 | Blumel et al. | 165/152 |

FOREIGN PATENT DOCUMENTS

| | | | | |
|---|---|---|---|---|
| FR | 367584 | * | 11/1906 | 165/109.1 |
| JP | 60-60495 | | 4/1985 | |
| JP | 03117896 A | * | 5/1991 | 165/179 |

* cited by examiner

*Primary Examiner*—Leonard Leo
(74) *Attorney, Agent, or Firm*—Scott M. Confer

(57) ABSTRACT

A twisted-louver high performance heat exchanger fin assembly includes a plurality of fin elements each having a louver formed therein. The louvers include first and second portions connected by a twisted portion such that the first and second portions cross in an X-shaped profile.

7 Claims, 3 Drawing Sheets

TWISTED-LOUVER HIGH PERFORMANCE HEAT EXCHANGER FIN

FIELD OF THE INVENTION

The present invention relates generally to the field of heat exchangers for automotive vehicles, and particularly to a heat exchanger fin that increases heat exchanger efficiency.

BACKGROUND OF THE INVENTION

Air-cooled fin-type heat exchangers for automobiles are very well known. They are used for reducing the temperature of various working fluids, including engine coolant, engine lubricating oil, air conditioning refrigerant, and automatic transmission fluid, among others. The heat exchanger typically includes a plurality of spaced fluid conduits or tubes connected between an inlet and an outlet, and a plurality of heat exchanging fins interposed between adjacent conduits. Air is directed across the fins via a cooling fan or the motion of the automobile. As the air flows across the fins, heat in the fluid flowing in the tubes is conducted through the walls of the tubes into the fins and transferred or "exchanged" into the airflow.

One of the primary goals in heat exchanger design is to achieve the highest possible thermal efficiency. Thermal efficiency is measured by dividing the amount of heat that is actually transferred by the heat exchanger in a given set of conditions (amount of airflow, temperature difference between the air and fluid, etc.) by the theoretical maximum possible heat transfer under those conditions. An increase in the rate of heat transfer, therefore, results in greater thermal efficiency. Improved heat transfer can be realized by forming the fins and/or louvers on the fins at a predetermined angle in a manner also well known in the art.

Heat transfer is also affected by the air pressure drop associated with the change in airflow direction caused by the fins and louvers. A greater air pressure drop results in less heat transfer. Various types of fin and louver designs have been disclosed in the prior art with the object of increasing the heat exchanger efficiency by making improvements in the fins, louvers, and airflow pattern.

Examples of these prior art fin and louver designs include the staggering of fin rows in order to increase the amount of air encountered by the heat exchanger. Some designs have fin and louver assemblies manufactured at different angles determined by the amount of airflow through each louver. Other designs include louvers formed at an angle to the fin wall, rather than square to the fin wall. Still other designs vary the cross-section of the fins and louvers. All of these prior art designs, however, have heat exchanger fins that are symmetrical across their entire length. Further, the prior art discloses heat exchangers with multiple changes of airflow direction. In the prior art, air flows through the louvers until it reaches a middle transition piece. There the air changes direction and flows through louvers until it exits the heat exchanger.

The art continues to seek improvements. It continues to be desirable to increase overall heat exchanger efficiency. Fin design continues to play an important role in increasing heat exchanger efficiency.

SUMMARY OF THE INVENTION

The present invention concerns an apparatus for increasing heat exchanger efficiency by utilizing a novel fin design that is not symmetric across its entire length and has only one change in airflow direction. As noted above, the prior art discloses cooling tube fin louvers that are manufactured at a predetermined angle to the fins and are symmetric across their entire length when viewed from either its horizontal or vertical centerline. The angle of the louvers to the fin axes in the prior art remains constant (regardless of the cross-section of the louver) throughout the length of the fin element. Unlike the prior art, the present invention louvers are twisted at a midpoint, so that when viewed along a horizontal centerline, an X-shaped cross-section is observed. The twist separates the louver into two portions, with a resulting angle formed between the portions, as viewed in the X-shaped cross-section.

The angle formed between the portions of the louver on either side of the twist, however, is not limited to any particular value. The angle between the portions of the louver formed by the twist should be appropriate to the requirements of the heat exchanger. The angle between the portions, therefore, could be acute, perpendicular, or obtuse.

The twist in the louver allows each portion of the louver to maintain and direct airflow in a single direction, with only one change of direction, for minimum pressure drop. Air flows through the first set of louvers, then enters the next stage of fins, then the next, until it exits the heat exchanger. The air changes direction only once—when it enters the heat exchanger through the first louvers, thus an improvement in airflow is obtained. The air is able to absorb more heat without a loss of efficiency via a pressure drop. As noted above, prior art heat exchangers disclose multiple air direction changes through the louvers. Every change in airflow direction causes a corresponding, and undesirable, pressure drop, which resulted in less heat transfer and, therefore, less efficiency. As a result of the single change in airflow direction with the twisted-louver high performance heat exchanger fin of the present invention, a decreased pressure drop across the heat exchanger is realized, as is an increase in heat exchanger efficiency.

Many benefits can be gained by utilizing the heat exchanger fin of the present invention. A heat exchanger may be made of a smaller physical size than prior art heat exchangers with the same cooling capacity, thus saving weight. Conversely, the heat exchanger could be made the same physical size and the electric motor used to drive the cooling fan could be sized smaller because of the greater efficiency of the heat exchanger. This could reduce the required voltage capacity of the vehicle's electrical system, since the cooling fan motor is often the largest electric load in the vehicle. In addition, the twisted-louver high performance heat exchanger fin is no more expensive to manufacture than traditional type louvers, and is in fact cheaper to manufacture than staggered row fin louvers or fin louvers with varying angles of attack.

Various objects and advantages of this invention will become apparent to those skilled in the art from the following detailed description of the preferred embodiment, when read in light of the accompanying drawings.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
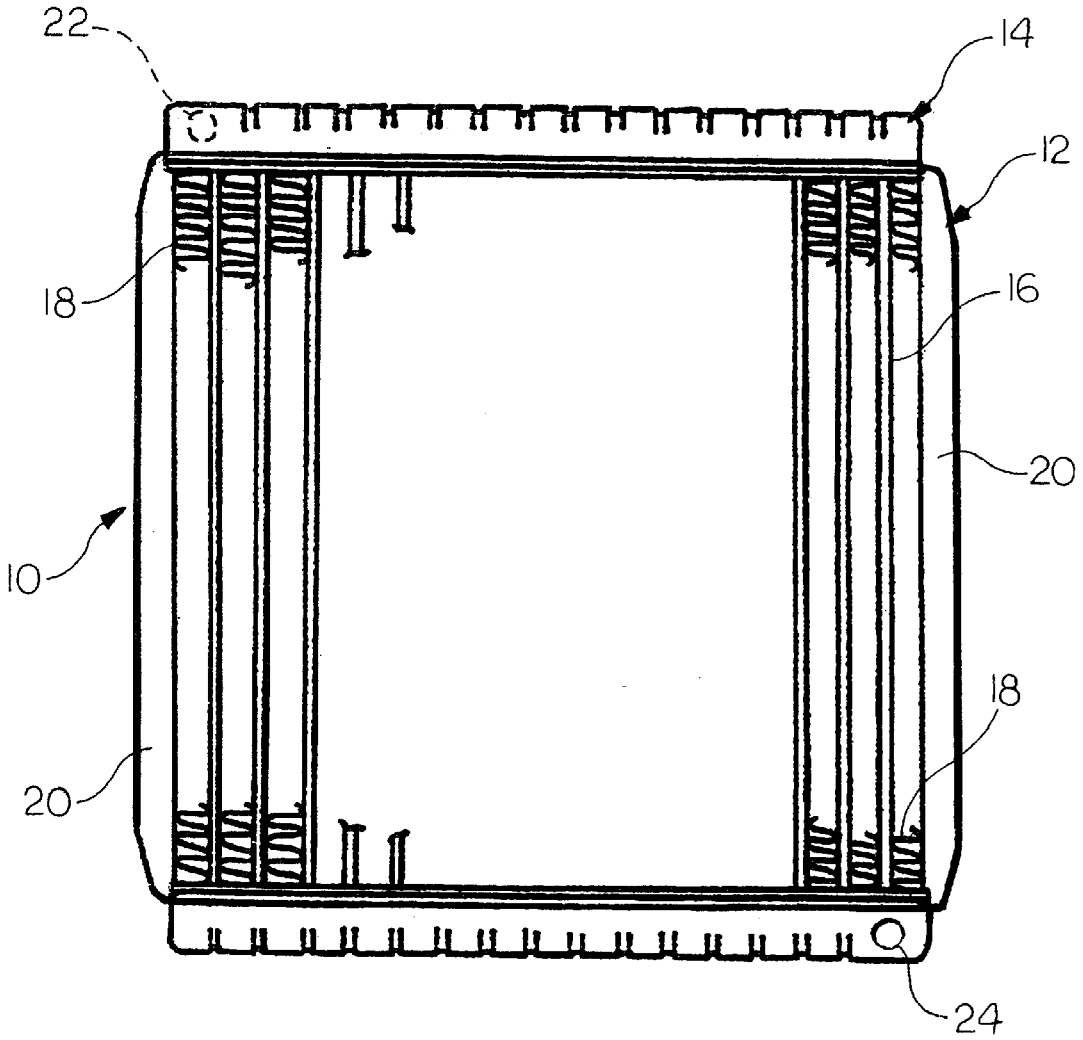
FIG. 1 Prior Art
FIG. 1 is a cross-sectional view of a typical heat exchanger.

Illustrated in FIG. 1 is a prior art automotive heat exchanger 10, such as a radiator, including a core 12 comprising a plurality of tubes 16 interleaved with a plurality of fin assemblies 18. The radiator 10 includes a manifold assembly 14 through which fluid flows into each of the tubes 16. The radiator 10 can either include a single manifold disposed at one end of the core 12 or may have a pair of manifolds disposed at opposite ends of the core. Side supports 20 are disposed on opposite sides of the core 12 and provide structural rigidity to the radiator 10. The manifold 14 includes a fluid inlet at a port 22 and a fluid outlet at a port 24 for entry and exit respectively of a fluid.

While the present invention is described for use in the radiator 10, it can be used in other types of automotive heat exchangers including, but not limited to, evaporators, heater cores, and oil coolers.

Figure 2:
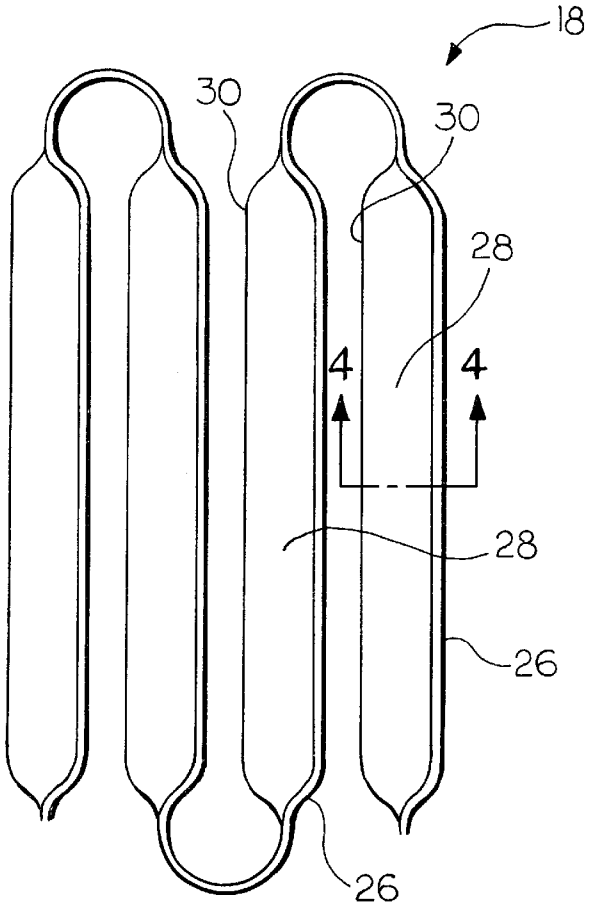
FIG. 2 Prior Art
FIG. 2 is an enlarged fragmentary view of one of the fin assemblies shown in FIG. 1.

Referring to FIG. 2, the typical corrugated fin assembly 18 includes a plurality of fin elements 26 each having a louver 28 formed thereon. The louver 28 extends from the fin 26 at a predetermined angle with respect to the flow of air and is formed by lancing to define an aperture opened in substantially the same direction thereof. The aperture allows the flow of air therethrough and directs the flow of air against the adjacent fluid tube as is well known in the art. The louver 28 includes an outer edge 30 disposed generally parallel to the plane of the fin 26 along substantially the entire length of the louver.

Figure 3:
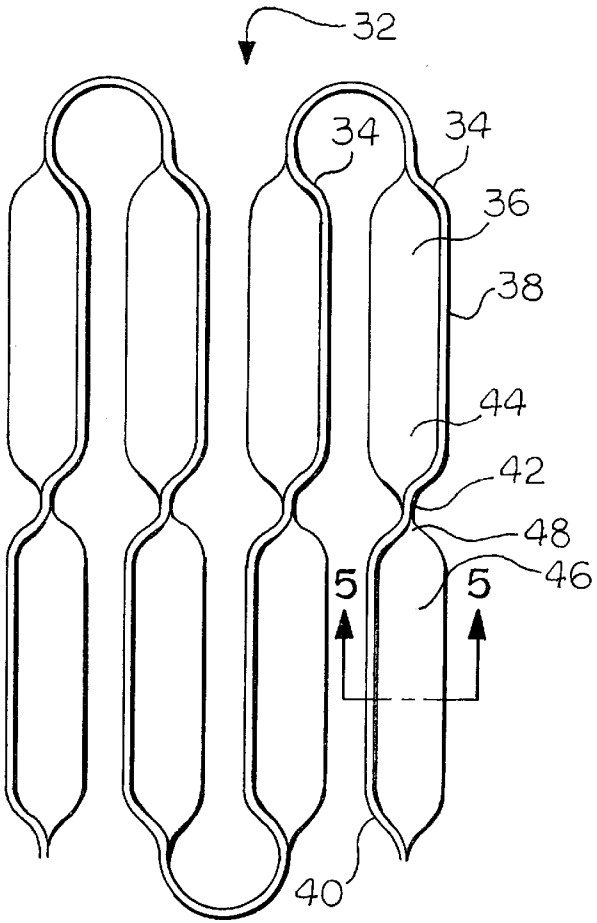
FIG. 3 is an enlarged fragmentary view, similar to FIG. 2, of a twisted-louver high performance heat exchanger fin assembly according to the present invention.

A twisted-louver high performance heat exchanger fin assembly 32 according to the present invention is shown in FIG. 3. The fin assembly 32 includes a plurality of fin elements 34 each having a louver 36 formed thereon. Each fin 34 has a first portion 38 extending in a first plane, a second portion 40 extending in a second plane generally parallel to the first plane, and a generally S-shaped curved central portion 42 connecting the first and second portions. The louver 36 includes a first generally planar end portion 44 extending from the fin first portion 38 at a first predetermined angle with respect to the flow of air and is formed by any suitable method to define an aperture opened in substantially the same direction thereof. The aperture allows the flow of air therethrough and directs the flow of air against the adjacent fluid tube as is well known in the art. The louver 36 includes a second generally planar end portion 46 extending from the fin second portion 40 at a second predetermined angle with respect to the flow of air and is formed by any suitable method to define an aperture opened in substantially the same direction thereof. The end portions 44 and 46 are joined by a twisted portion 48 extending from the curved portion 42 of the fin. In the embodiment shown in the drawings, a width of the end portion 44, a width of the end portion 46, and a width of the twisted portion 48 are substantially equal.

Figure 4:
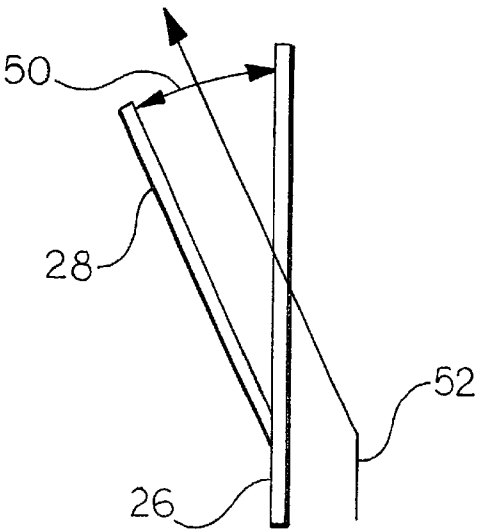
FIG. 4 Prior Art
FIG. 4 is a cross-sectional view of the fin assembly shown in FIG. 2 taken along the line 4—4.

FIG. 4 is a schematic representation of a cross-sectional view through one of the fins 26 and the associated louver 28 of FIG. 2. The louver 28 extends at a predetermined angle 50 from a plane of the fin 26. An arrow 52 represents an airflow path along the fin 26 and through the aperture left by the formation of the louver 28. The airflow path 52 is the same for all of the prior art fins 26 shown in the FIG. 2.

Figure 5:
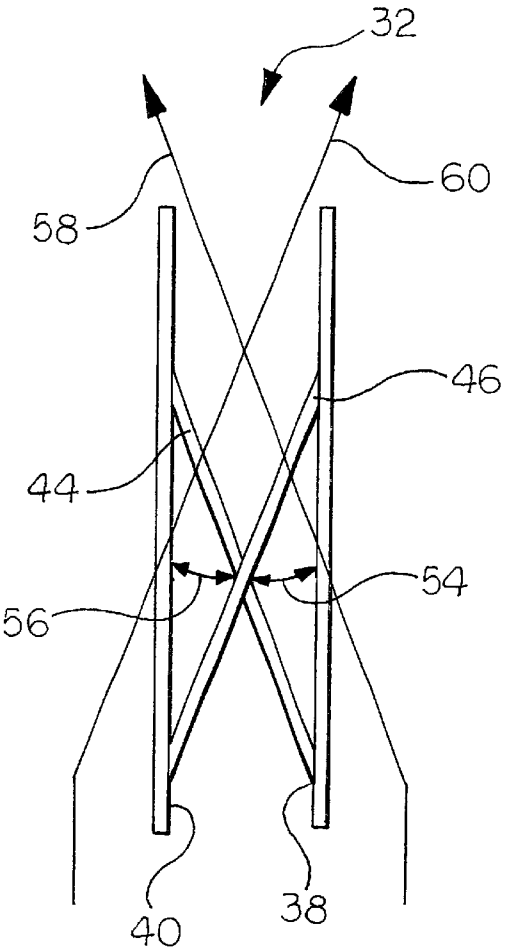
FIG. 5 is a cross-sectional view of the fin assembly shown in FIG. 3 taken along the line 5—5.

FIG. 5 is a schematic representation of a cross-sectional view through one of the fins 34 and the associated louver 36 of FIG. 3. The louver portions 44 and 46 form an X-shaped profile for the louver 36. The first louver portion 44 extends at a first predetermined angle 54 from a plane of the fin portion 38. The second louver portion 46 extends at a second predetermined angle 56 from a plane of the fin portion 40. The angles 54 and 56 can be perpendicular, acute, or obtuse, as is appropriate to the requirements of the heat exchanger, and do not have to be the same.

The twist in the louvers 36 at the midpoint 42 allows air to flow in different directions over the first and second end portions 44 and 46 as shown by arrows 58 and 60. When a plurality of the twisted-louver high performance heat exchanger fin assemblies are installed as a system, the air flows in a pattern with only one change in direction throughout the heat exchanger, which results in a small pressure drop across the heat exchanger.

In accordance with the provisions of the patent statues, the present invention has been described in what is considered to be its preferred embodiment. However, it should be noted that this invention may be practiced otherwise than as specifically illustrated and described without departing from its spirit or scope.

What is claimed is:

1. A twisted-louver high performance heat exchanger fin assembly comprising:

a plurality of fin elements, each said fin element having first and second portions extending in associated generally parallel planes;

a first louver portion formed in said fin element first portion, said first louver portion being generally planar and extending at a first predetermined angle from said plane of said fin element first portion; and a second louver portion formed in said fin element second portion, said second louver portion being generally planar and extending at a second predetermined angle from said plane of said fin element second portion, said first and second louver portions connected by a twisted portion and crossing in an X-shaped profile, wherein a width of said first louver portion, a width of said second louver portion, and a width of said twisted portion are substantially equal.

2. The heat exchanger fin assembly according to claim 1 wherein said first and second angles are the same.

3. The heat exchanger fin assembly according to claim 1 wherein said fin element first and second portions are connected by a generally S-shaped central portion.

4. A twisted-louver high performance heat exchanger fin assembly comprising:

a plurality of fin elements, each said fin element having first and second portions extending in associated generally parallel planes connected by a curved central portion;

a first louver portion formed in said fin element first portion, said first louver portion being generally planar and extending at a first predetermined angle from said plane of said fin element first portion;

a second louver portion formed in said fin element second portion, said second louver portion being generally planar and extending at a second predetermined angle from said plane of said fin element second portion, said first and second louver portions crossing in an X-shaped profile; and a twisted portion connecting said first and second louver portions, wherein a width of said first louver portion, a width of said second louver portion, and a width of said twisted portion are substantially equal.

5. The heat exchanger fin assembly according to claim 4 wherein said first and second angles are the same.

6. The heat exchanger fin assembly according to claim 4 wherein said central portion is generally S-shaped.

7. A heat exchanger comprising:

at least one manifold connected to a plurality of fluid flow tubes;

a plurality of fin elements interposed between said tubes, each said fin element having first and second portions extending in associated generally parallel planes connected by a curved central portion;

a first louver portion formed in said fin element first portion, said first louver portion being generally planar and extending at a first predetermined angle from said plane of said fin element first portion; and a second louver portion formed in said fin element second portion, said second louver portion being generally planar and extending at a second predetermined angle from said plane of said fin element second portion, said first and second louver portions crossing in an X-shaped profile, wherein a width of said first louver portion, a width of said second louver portion, and a width of said curved portion are substantially equal.

* * * * *